US007585092B2

(12) United States Patent
Huffman

(10) Patent No.: US 7,585,092 B2
(45) Date of Patent: Sep. 8, 2009

(54) MOTION-ACTIVATED LAMPS

(75) Inventor: Tom Huffman, Encinitas, CA (US)

(73) Assignee: Thomas Huffman, Olivenhain, CA (US)

( * ) Notice: Subject to any disclaimer, the term of this patent is extended or adjusted under 35 U.S.C. 154(b) by 264 days.

(21) Appl. No.: 11/551,681

(22) Filed: Oct. 20, 2006

(65) Prior Publication Data

US 2008/0094827 A1 Apr. 24, 2008

(51) Int. Cl.
*F21V 23/04* (2006.01)

(52) U.S. Cl. ..... 362/276; 362/394; 362/198; 362/410

(58) Field of Classification Search ..... 362/276, 362/411, 394, 295, 198, 410, 395
See application file for complete search history.

(56) References Cited

U.S. PATENT DOCUMENTS

| | | | | |
|---|---|---|---|---|
| 4,413,364 | A | 11/1983 | Bittaker et al. | |
| 5,015,994 | A | 5/1991 | Hoberman et al. | |
| 5,150,962 | A | 9/1992 | Rauschenberger | |
| 5,276,595 | A | 1/1994 | Patrie | |
| 5,381,323 | A | 1/1995 | Osteen et al. | |
| 5,489,891 | A * | 2/1996 | Diong et al. | 340/567 |
| 5,757,004 | A | 5/1998 | Sandell et al. | |
| 5,763,872 | A | 6/1998 | Ness | |
| 5,790,040 | A | 8/1998 | Kreier et al. | |
| 6,323,488 | B1 | 11/2001 | McCavit et al. | |
| 6,909,239 | B2 | 6/2005 | Guana | |
| 6,956,493 | B1 | 10/2005 | Youngblood | |
| 7,034,230 | B2 | 4/2006 | Fan | |
| 7,036,158 | B2 | 5/2006 | Bradford et al. | |
| 7,045,975 | B2 | 5/2006 | Evans | |
| 2002/0105797 | A1 | 8/2002 | Navid et al. | |
| 2003/0016532 | A1 * | 1/2003 | Reed | 362/198 |

* cited by examiner

*Primary Examiner*—Bao Q Truong

(57) ABSTRACT

Motion-activated lamps are disclosed herein. Preferred motion-activated lamps include a free-standing base housing a motion sensor and a battery power source operably connected to an electrical circuit, an adjustable neck, and means for emitting light.

1 Claim, 2 Drawing Sheets

MOTION-ACTIVATED LAMPS

FIELD OF THE INVENTION

The invention described herein generally relates to battery-powered lamps that are activated by motion and have means for adjusting the direction of the emitted light.

BACKGROUND

Motion-activated lights are well known in the field of commercial and residential security systems. Typically these systems are designed to produce bright light to alert or frighten an intruder that has been detected by the light's sensor.

One example of a motion-activated security light is disclosed in U.S. Pat. No. 6,956,493, to Youngblood. This particular patent discloses a security light that derives it power from an electrical outlet. According to Youngblood, outlet derived power is preferred over battery power because batteries can lead to unreliable and expensive operation. Additionally, Youngblood alleges that the amount of light output is compromised in relationship to the draw on battery power. See Youngblood, col. 1, lines 50-57. While Youngblood teaches away from using batteries, their system is disadvantaged because it is reliant on having an electrical outlet nearby. A dependence on electrical outlets thus significantly limits the portability of Youngblood's light.

Another example of a motion-activated security light that plugs into an electrical outlet is described in U.S. Pat. No. 5,015,994, to Hoberman et al. While this patent emphasizes a smaller light, its portability is still limited to areas where an electrical outlet is present. Moreover, Hoberman et al. does not teach means for adjusting the direction of the emitted light. Accordingly, the light described in Hoberman et al. is limited to being plugged into an electrical outlet and only emits light in a direct outward path from the outlet. These limitations significantly hinder Hoberman's portability and functionality.

In light of the prior art, there is a need in the art for a fully portable motion-activated light that does not rely on having an electrical outlet nearby and has means for adjusting the direction of emitted light.

Accordingly, one objective of the teachings herein is to provide a fully portable motion-activated lamp that can be utilized away from an electrical outlet. Another objective of the teachings herein is to provide a motion-activated light that has means for adjusting the direction of emitted light. A further objective of certain embodiments provided herein is to provide a motion-activated lamp that will emit light in the absence of sufficient ambient light. Another objective of the teachings herein is to provide a free-standing motion-activated lamp that can be situated on substantially flat surfaces.

SUMMARY OF THE INVENTION

In preferred embodiments, lamps are provided for emitting light in a particular direction including, a motion sensor, means for emitting light, a base configured to house a battery power source operably connected to an electrical circuit, wherein the electrical circuit is configured to activate through the motion sensor, and means for adjusting the direction of emitted light.

In preferred embodiments the battery power source can be 3 AAA alkaline batteries. In addition to having a battery source, the lamps provided herein can also include means for plugging into an electrical outlet in certain embodiments.

Advantageous motion sensors include a pyroelectric infrared (PIR) sensor in operable connection with a Fresnel lens, and the like.

Preferred means for adjusting the direction of emitted light is a segmented neck, wherein said neck houses electrical wires operably connecting the base to the means for emitting light.

In other advantageous embodiments, the lamps described herein can comprise an externally accessible ON/OFF dial operably connected to the electrical circuit and configured to prevent or allow power transfer. Further embodiments contemplate a control for adjusting the amount of time the light is emitted after motion is detected by the sensor.

Additional embodiments include lamps housing an electrical circuit that is configured to activate through a photoelectric sensor in addition to a motion (e.g., PIR) sensor. Further embodiments include a free-standing base having a substantially flat bottom surface that allows the lamp to be placed on substantially flat surfaces.

BRIEF DESCRIPTION OF THE DRAWINGS

It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Embodiments of the present invention are described below. It is, however, expressly noted that the present invention is not limited to these embodiments, but rather the intention is that modifications that are apparent to the person skilled in the art and equivalents thereof are also included.

In general, the invention described herein is related to battery-powered, motion-activated lamps. In preferred embodiments, the motion-activated lamps described herein include 1) a base, 2) an adjustable neck, or means for adjusting the direction of the emitted light, and 3) a head piece. It is preferred that the lamp's parts are constructed of either plastic, metal or glass.

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention.

Figure 1:
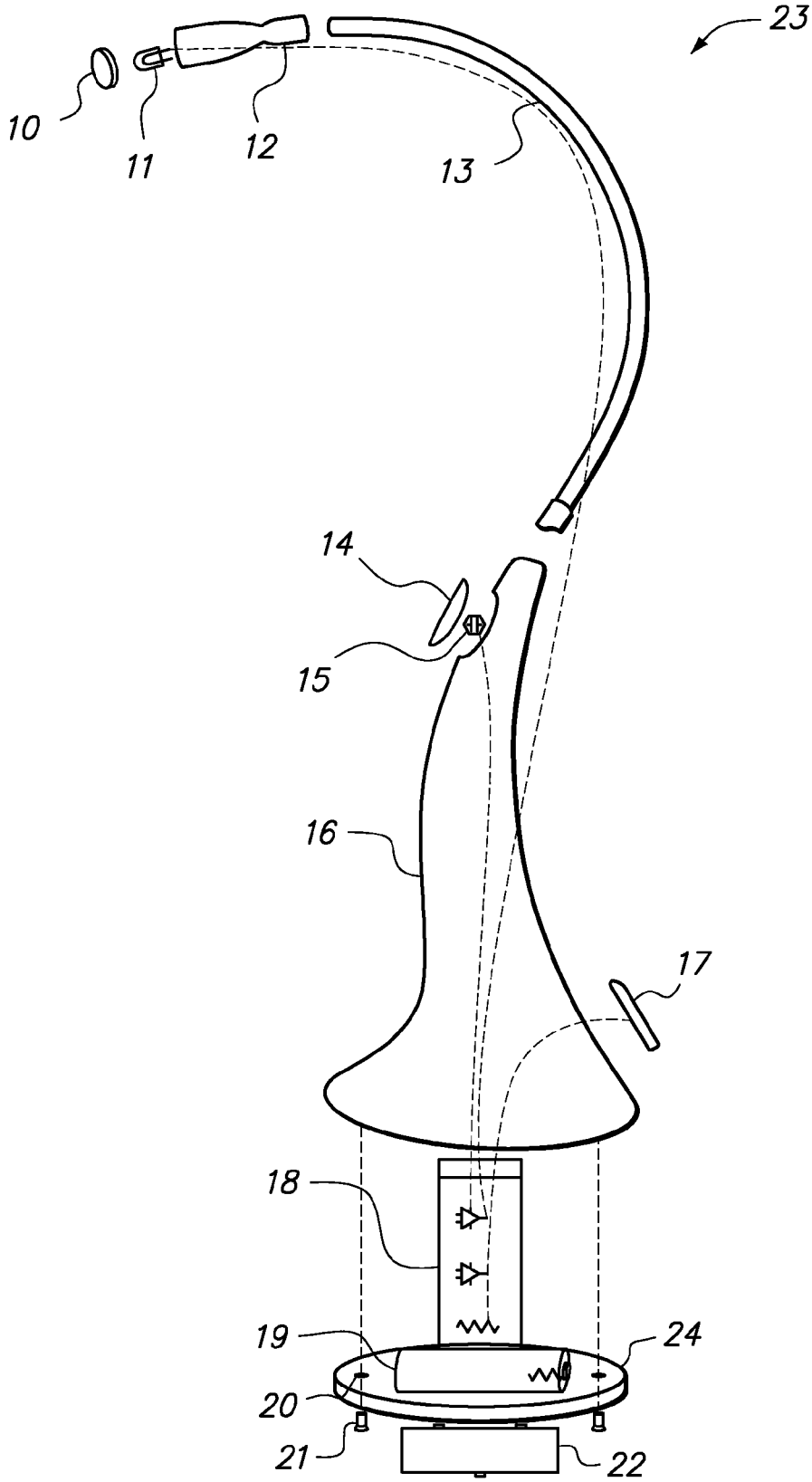
FIG. 1 is an exploded view of one embodiment of the motion-activated lamps provided herein.

FIG. 1 depicts an exploded view of a preferred motion-activated lamp 23 having a base 16, an adjustable neck 13, and a head piece 12. In preferred embodiments, the base 16 houses an electrical circuit 18 coupled to a battery 19 and an ON/OFF dial 17. In preferred embodiments, the electrical circuit 18 can be mounted on a printed circuit board (PCB).

The ON/OFF dial 17 is configured such that the power will not flow through the electrical circuit 18 when it is turned "OFF". Similarly, turning the ON/OFF dial 17 "ON" enables power flow from the battery 19 through the circuit 18. In other preferred embodiments, the ON/OFF dial 17 is configured to control the amount of power flowing through the electrical circuit 18, thereby allowing for brighter or dimmer light emission from the lamp. While depicted in FIG. 1 as being located in the back-side of the base 16, the ON/OFF dial 17 can be located on the front-side of the base 16, or any other location on the base 16, the adjustable neck 13, or on the headpiece 12, so long as it is electrically coupled to the circuit 18 and battery 19.

In advantageous embodiments, the base 16 has a flattened base plate 24 to allow the lamp 23 to stand unassisted or free-stand on substantially flat surfaces. In advantageous embodiments, the lamps described herein are highly portable and can be placed in multiple locations a user desires, whether inside or outside. According to preferred embodiments, the lamps disclosed herein are configured to utilize a battery power source and do not have means for plugging into an electrical outlet. In other embodiments, it is contemplated that the lamps provided herein can include means for plugging into an electrical outlet while at the same time being configured to utilize a battery power source. This embodiment can be especially advantageous if the user does not have batteries available or if the lamps are using rechargeable batteries that are configured to be charged while the lamp is plugged into an electrical outlet.

A non-limiting preferred location for the lamps described herein is on top of a toilet tank such that the lamp acts as a bathroom night light directed to the toilet bowl below. According to one embodiment, the lamp can emit a soft light when a user, desiring to urinate at night, passes in front of the lamp's motion sensor. According to another embodiment, when the user leaves the sensor's field, the lamp can turn off after a pre-determined amount of time has elapsed (e.g., 0 seconds to 5 minutes). In a preferred embodiment, the lamp includes a light sensor (e.g., photoelectric sensor) that is configured such that the lamp will not activate if any significant ambient light is already present in the room. According to this embodiment, the user can activate the soft light emitting lamp in the dark, without having to physically turn on a bright bathroom light.

According to a further, non-limiting embodiment, the lamps described herein can be used to illuminate displayed art, such as in a gallery for example. More specifically, when an observer passes in front of the lamp's motion sensor, the light can be used to illuminate various types of art including paintings, pictures, sculptures, and the like. As disclosed above, in preferred embodiments, the lamps provided herein can also include means for adjusting a light sensitive sensor (e.g., photoelectric sensor) such that the activation of the lamp is dependent upon a predetermined amount of light present in the room. According to certain embodiments, an art observer would not necessarily need to walk into a dark room in order to activate the lamps described herein.

In further embodiments, the lamps provided herein can be used as an emergency flashlight. In these embodiments, it is preferred that the base is configured to easily be held in the hand of a user. In even more specific embodiments, a motion-activated sensor and or photoelectric sensor can assist a user in finding the lamp at night or in an emergency. For example, if a user made sufficient movement in the dark near the flashlight, the motion sensor would detect the motion and activate the signal to emit light, thus enabling the user to readily ascertain the location of the light.

In more specific embodiments, the base plate 24 of the lamp contains holes 20 to allow screws 21 to connect the base plate 24 to the base 16. In addition to screws 21, any other suitable means for connecting the base plate to the base can be used, including adhesives, snaps, tabs, and other fasteners. In more specific aspects, the base plate 24 also contains a lid 22 to contain 1 or more batteries 19 inside of the base 16. In further embodiments, the lid 22 can be readily removed by a hinge, snaps, and/or tabs for example, to allow for removal and installation of a battery 19. In other preferred aspects, the base plate 24 and lid 22 are configured to secure the 1 or more batteries 19 such that they remain connected to the electrical circuit 18, and do not significantly move within the base 16.

The lamps described herein can be powered by 1 or more suitable batteries 19. In preferred embodiments, the lamps described herein can be powered by 1, 2, 3, 4, or 5 alkaline batteries, including but not limited to D, C, AA, and AAA, PP3 batteries. In other embodiments, 1 or more 9 volt alkaline batteries can be used as a power source.

In other advantageous aspects, 1, 2, 3, 4 or more lithium batteries can be used to power the lamps described herein. Non-exclusive examples of lithium batteries that can be used with the teachings herein include lithium thionyl chloride batteries, and lithium manganese oxide batteries, and the like. In advantageous embodiments, 1 or more 6 Volt or 3 Volt lithium batteries can used to power the motion-activated lamps described herein. In still further embodiments, 1 or more 3.5 Volt, AA, 2.1 AH rated lithium batteries can be used as a power source. Those with skill in the art can readily select an appropriate power source 19 that is compatible with the power requirements of the selected means for emitting light 11. In further aspects, alkaline or lithium rechargeable batteries can be used to power the lamps described herein.

In preferred embodiments, the base 16 of the lamp houses a motion sensor 15 that detects changes in infrared radiation. In general, "infrared light" relates to light of a wavelength that is longer than visible light and shorter than that of radio waves on the electromagnetic spectrum. Infrared light has a range of wavelengths. For example, "near infrared" light is closest in wavelength to visible light and "far infrared" is closer to the microwave region of the electromagnetic spectrum. In general, infrared radiation spans three orders of magnitude and has wavelengths between approximately 750 nm and 1 mm.

In more particular embodiments, the motion sensor 15 is configured such that it can detect the heat emitted from a living body located within the sensor field or monitored area. In advantageous aspects, infrared detection is sensed by a pyroelectric infrared motion sensor (PIR), which is also commonly referred to as a passive infrared sensor. In general, a PIR sensor utilizes a lens 14 that focuses radiated heat energy toward a focal point on the PIR sensor 15.

Various lens choices are available to customize the PIR sensor 15 to meet the preferences of the monitored area. For example, the PIR sensor can be adjusted to achieve broad coverage, narrow coverage, or to allow pet movement. One type of preferred PIR sensor lens 14 is a Fresnel lens which is readily known in the art. In advantageous aspects, the PIR sensor 15 can be mounted on a printed circuit board (PCB), upon which the electrical circuit 18 can also be mounted.

In preferred embodiments, the space between the lens 14 and the PIR sensor 15 is kept substantially vacant to allow heat energy to be directed to the motion sensor 15. In other desirable aspects, this space can be sealed to reduce undesirable effects caused by air drafts and intruding insects, for example.

In further embodiments, a vision restrictor and/or a vision extender can be used in conjunction with the lens 14 to restrict or expand the scope of the sensor respectively. Vision restrictors and extenders are well known in the art, and some examples are described in U.S. Pat. No. 5,015,994 to Hoberman et al., which is hereby incorporated by reference in its entirety.

In other advantageous embodiments, the base 16 can also house a "light sensor" such as a photoelectric sensor such that the lamps will emit illumination only when an insufficient amount of ambient light is available. This embodiment is particularly useful for utilizing the lamps as night lights, or when it is otherwise dark. In other embodiments, a photoelectric sensor can be configured to allow activation of the lamp in the presence of dim light, normal light, or bright light. A photoelectric sensor can readily be coupled to a circuit board within the base 16.

In other preferred aspects, the lamps provided herein can include a control to set the period of time the lamp emits light after motion is detected. These times can vary depending on the particular use of the lamps. For example, in certain embodiments, the lamps can be adjusted remain on for about 10, 20, 30, 40, 50, 60, 70, 80, 90, or 100 seconds, or even 2, 3, 4, 5, 10, 15, 20, 25, or 30 minutes after motion is detected. In other embodiments, the lamps described herein can remain on as long as the motion sensor 15 detects sufficient heat emission from a body. According to this specific embodiment, the lamps will stop emitting light after the user leaves the sensor's monitoring field.

Figure 2:
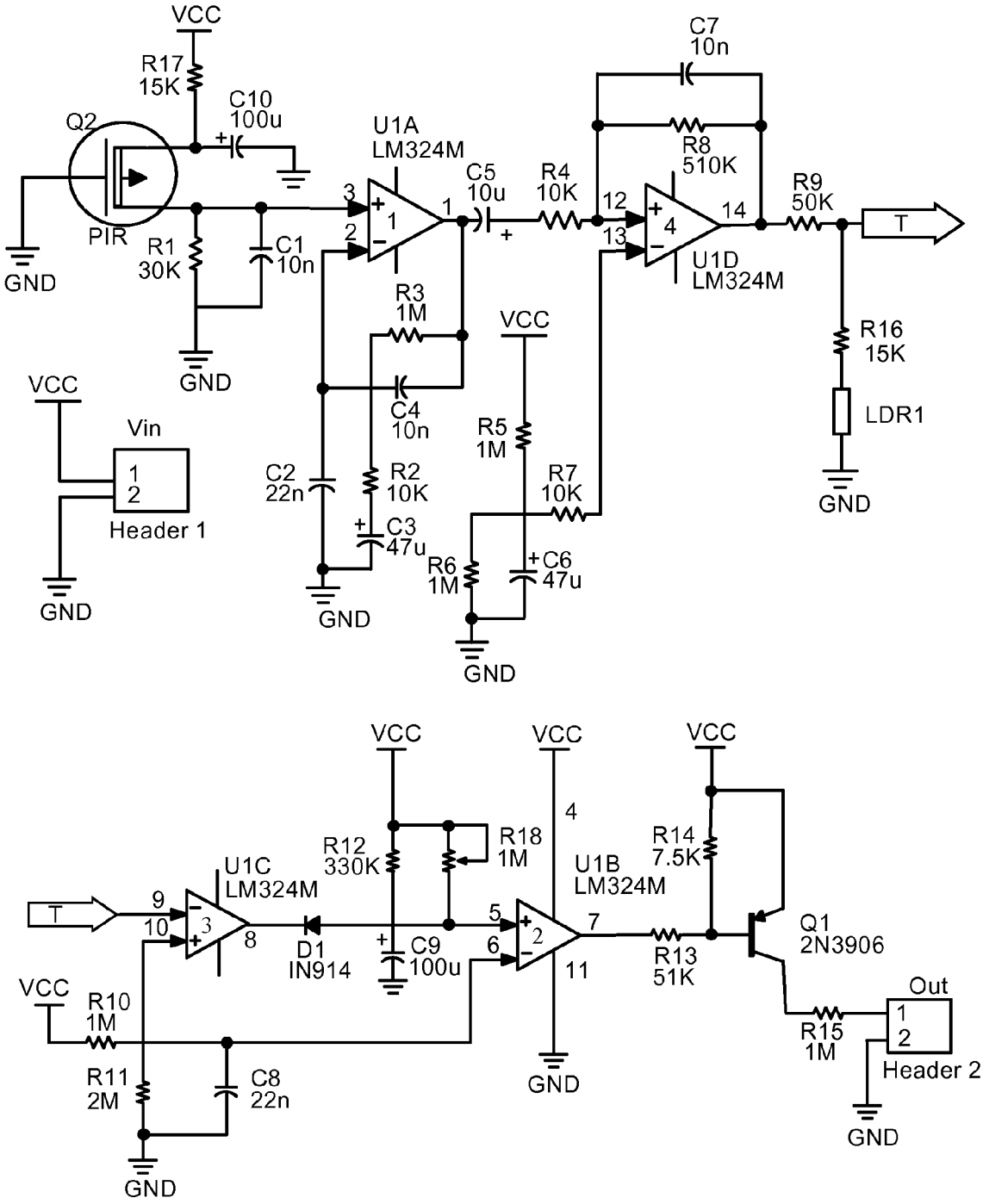
FIG. 2 is a schematic view of one preferred embodiment of an electrical circuit used to activate the lamps provided herein.

FIG. 2 is a schematic diagram of a preferred electrical circuit board that can be utilized with the lamps provided herein. Description for the listed parts, along with their assigned designators, quantities, and values are provided in Table 1 below. While FIG. 2 is one preferred embodiment, those with skill in the art will readily appreciate that numerous other similar PIR-based circuits could also work with the teachings herein.

With reference to FIG. 2, visible light detection is performed by R9, R16 and the LDR (Light Dependant Resistor). As the intensity of light changes, the resistance of the LDR changes so the output of the voltage divider composed by R9, R16 and the LDR, marked by T in the circuit, changes. This change is detected by the signal conditioning section and the output is generated. If there is significant ambient light detected, the circuit will not activate.

Referring to FIG. 2, infrared detection is sensed by the PIR motion sensor, which includes a field effect transistor (FET). The detected signal is then processed further by two operational amplifiers U1A and U1D and their respective filters. The PIR pin is pulled down to ground by R1 and feeds the two stage amplifier/filter. The other pin is pulled up to VCC by R17. C10 is effective at maintaining the voltage at PIR substantially free of high frequency noise. C1 assists in effectively limiting high frequency noise from entering the amplifier stage.

With continued referenced to FIG. 2, U1A is a non inverting amplifier with a gain of 100 (=R3/R2) that substantially filters out undesirable noise. The filter is a signal follower (the gain is 1) at zero frequency and effectively rejects unwanted high frequency noise. C5 effectively serves as a filter and substantially rejects the DC signal. The second stage amplifier, U1D has a gain of −51 (='R8/R4), thereby making the total gain of the both amplifier stages at −5100.

In accordance with FIG. 2, a comparator is provided around U1C. The input voltage to pin 9, from the detectors, is compared to V0=Vcc. R11/(R10+R11)=2Vcc/3. If the input voltage is higher than V0, the out pin (pin 8) goes down to zero. If the input voltage is lower than V0, the output pin 8 will go to VCC.

With respect to FIG. 2, if pin 8 goes low, the capacitor C9 is discharged, the input to U1B (pin 5) goes to zero and so does the output pin 7. This causes the transistor Q1 to cut, thereby preventing circuit output. In comparison, if pin 8 goes high, the diode D1 cuts off and C9 begins to charge through R12. After time, the input to pin 5 goes higher than pin 6 and the output pin 7 goes to VCC.

With continued reference to FIG. 2, the R12 and C9 time constant determines how long the output signal remains active. The potentiometer, or variable resistor R18, is in parallel with R12 on the circuit diagram, but when the circuit is built, it will replace R12 to facilitate adjustment. Thus, the output will be active over a time delay as determined by the user. The equation for time delay is C9*(R18 (low)) to C9* (R18(high)). The low and high range of the resistor will most likely be between 330K and 1M which translates to an approximate output activation from between 33 seconds to 100 seconds.

TABLE 1

| Description | Designator | Quantity | Value |
|---|---|---|---|
| Capacitor | C1 | 1 | 10 n |
| Capacitor | C2 | 1 | 22 n |
| Polarized Capacitor (Radial) | C3 | 1 | 47 u |
| Capacitor | C4 | 1 | 10 n |
| Polarized Capacitor (Radial) | C5 | 1 | 10 u |
| Polarized Capacitor (Radial) | C6 | 1 | 47 u |
| Capacitor | C7 | 1 | 10 n |
| Capacitor | C8 | 1 | 22 n |
| Polarized Capacitor (Radial) | C9 | 1 | 100 u |
| Polarized Capacitor (Radial) | C10 | 1 | 100 u |
| High Conductance Fast Diode | D1 | 1 | 1N914 |
| Resistor | LDR1 | 1 | LDR |
| Header, 2-Pin | Out | 1 | Header 2 |
| PNP General Purpose Amplifier | Q1 | 1 | 2N3906 |
| RE46B | Q2 | 1 | PIR |
| Resistor | R1 | 1 | 30 K |
| Resistor | R2 | 1 | 10 K |
| Resistor | R3 | 1 | 1M |
| Resistor | R4 | 1 | 10 K |
| Resistor | R5 | 1 | 1M |
| Resistor | R6 | 1 | 1M |
| Resistor | R7 | 1 | 10 K |
| Resistor | R8 | 1 | 510 K |
| Resistor | R9 | 1 | 50 K |
| Resistor | R10 | 1 | 1M |
| Resistor | R11 | 1 | 2M |
| Resistor | R12 | 1 | 330 K |
| Resistor | R13 | 1 | 51 K |
| Resistor | R14 | 1 | 7.5 K |
| Resistor | R15 | 1 | 1M |
| Resistor | R16 | 1 | 15 K |
| Resistor | R17 | 1 | 15 K |
| Potentiometer | R18 | 1 | 1M |
| Low-Power Quad Operational Amplifier | U1 | 1 | LM324 |
| Header, 2-Pin | Vin | 1 | Header 2 |

The adjustable neck 13 can be attached to the top of the base 16 by any suitable means. Non-exclusive examples of means for connecting the neck 13 to the base 16 can include screws, adhesive, clips, tabs, circumferential pressure, and the like. In other advantageous embodiments, the neck's bottom end can be threaded and screwed into a grooved receiving portion of the top of the base. In further embodiments, the top of the base can be threaded and screwed into a grooved receiving bottom end of the neck. In preferred embodiments, the means for attaching the neck to the base allow for electrical wires leading up from the base 16, to pass through the adjustable neck 13 to the means for emitting light 11. In still other advantageous embodiments, the neck can include 1 or more electrical connectors (e.g., electrical prongs) that plug into a receiving receptacle at the top of the base 16. Similarly, the base 16 can include 1 or more electrical connectors (e.g., electrical prongs) that plug into a receiving receptacle at the bottom of the neck 13.

In advantageous embodiments the adjustable neck 13 is cylindrical, having a hollowed inner core, housing one or more wires that electrically couple the base 16, containing the battery power source 19, to the head piece 12 which houses the means for emitting light 11. The adjustable neck 13 can be made of any suitable material including but not limited segmented plastic or metal. Examples of suitable materials can be found for example in U.S. patent application Ser. No. 10/170,490 (Published Application No. 2003/0016532A1) to Reed and U.S. Pat. Nos. 1,692,394, 1,790,500, 3,582,536, 5,172,974, 5,521,803, 5,687,774, and 5,944,407, all of which are hereby expressly incorporated by reference in their entireties.

Any suitable means for adjusting the direction of emitted light, including a flexible neck 13, can be used with the teachings herein. Examples include one or more movable joints, flexible arms, bendable metal, pivotal connections, rotatable tubes, and the like.

The adjustable neck 13 can be attached to the bottom of the head piece 12 by any suitable means. Non-exclusive examples of means for connecting the neck 13 to the head piece 12 can include screws, adhesive, clips, tabs, circumferential pressure, and the like. In other advantageous embodiments, the neck's top end can be threaded and screwed into a grooved receiving portion of the bottom of the head piece 12. In further embodiments, the bottom of the head piece can be threaded and screwed into a grooved receiving top end of the neck. In preferred embodiments, the means for attaching the neck 13 to the head piece 12 allow for electrical wires leading up from the base 16, to pass through the adjustable neck 13 to the means for emitting light 11. In still other advantageous embodiments, the neck can include 1 or more electrical connectors (e.g., electrical prongs) that plug into a receiving receptacle at the bottom of the head piece 12 or the means for emitting light 11. Similarly, the head piece 12 or the means for emitting light 11 can include 1 or more electrical connectors (e.g., electrical prong) that plugs into a receiving receptacle at the top of the neck 13. In other embodiments, the lamps provided herein can lack a head piece and just have means for emitting light directly attached to the neck without a housing.

In preferred aspects, the head piece 12 houses a means for emitting light 11 operably coupled to the electrical circuit 18 and battery 19. Non-exclusive examples of means for emitting light include a light emitting diode (LED), fluorescent bulbs, incandescent bulb, halogen bulb, or other conventional light bulbs. In more specific embodiments the means for emitting light 11 (e.g., LED) and its optional lens 10 can be any available color such as red, orange, amber, yellow, green, blue or white. In other embodiments, a bi-color LED can be used to emit light. Bi-color LEDs typically have two LEDs wired in 'inverse parallel' (one forwards, one backwards) combined in one package with two leads.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

What is claimed is:

1. A motion-activated lamp for emitting light in a particular direction comprising:

a means for emitting light; a motion sensor, wherein the motion sensor is a pyroelectric infrared(PIR) sensor; a free-standing base configured to house a battery power source operably connected to an electrical circuit, wherein the battery power source being 3 AAA alkaline batteries, and wherein the electrical circuit is configured to activate the means for emitting light through the motion sensor; and a means for adjusting the direction of emitted light, a means for plugging into an electrical outlet, a Fresnel lens in operable communication with the PIR sensor, wherein the means for adjusting the direction of emitted light is an adjustably segmented neck, wherein said neck houses electrical wires operably connecting the base to the means for emitting light, wherein said lamp comprises an externally accessible ON/OFF dial operably connected to said electrical circuit and configured to prevent or allow power transfer, a control for adjusting the amount of time the light is emitted after motion is detected by the sensor; and a head piece housing a color lens and the means for emitting light operably coupled to the electrical circuit and the batteries; and the ON/OFF dial being configured to control the amount of power flowing through the electrical circuit, thereby allowing for brighter or dimmer light emission from the lamp; and the means for plugging into an electrical outlet while at the same time being configured to utilize the battery power source; and the lamp includes a light sensor that is configured such that the lamp will not activate if any significant ambient light is already present in the room; and a base plate of the lamp containing holes to allow screws to connect the base plate to the base, the base plate also contains a lid to contain one or more batteries inside of the base; the lid can be readily removed by a hinge, snaps, and/or tabs to allow for removal and installation of the battery; and the motion sensor can be mounted on a printed circuit board upon which the electrical circuit can also be mounted; and a space between the lens and the motion sensor being kept substantially vacant to allow heat energy to be directed to the motion sensor; and the space can be sealed to reduce undesirable effects caused by air drafts and intruding insects; and the adjustable neck can be removably attached to the top of the base; the neck's bottom end can be threaded and screwed into a grooved receiving portion of the top of the base, or the top of the base can be threaded and screwed into a grooved receiving bottom end of the neck; and the neck including one or more electrical connectors that plug into a receiving receptacle at the top of the base, or the base including one or more electrical connectors that plug into a receiving receptacle at the bottom of the neck; and the adjustable neck being cylindrical, having a hollowed inner core, housing one or more wires that electrically couple the base, containing the battery power source, to the head piece which houses the means for emitting light; and The adjustable neck being removably attached to the bottom of the head piece; the neck's top end can be threaded and screwed into a grooved receiving portion of the bottom of the head piece, or the bottom of the head piece can be threaded and screwed into a grooved receiving top end of the neck; and the neck including one or more electrical connectors that plug into a receiving receptacle at the bottom of the head piece, or the head piece including one or more electrical connectors that plugs into a receiving receptacle at the top of the neck 13.

* * * * *